US007004783B2

(12) United States Patent
Kumamoto et al.

(10) Patent No.: US 7,004,783 B2
(45) Date of Patent: Feb. 28, 2006

(54) CABLED CONNECTOR INCLUDING CABLE GUIDE ATTACHED DETACHABLY TO CONNECTOR COVER

(75) Inventors: Tadashi Kumamoto, Shinagawa (JP); Mitsuru Kobayashi, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/626,667

(22) Filed: Jul. 25, 2003

(65) Prior Publication Data

US 2004/0166723 A1 Aug. 26, 2004

(30) Foreign Application Priority Data

Feb. 20, 2003 (JP) ..... 2003-043049

(51) Int. Cl.
*H01R 13/62* (2006.01)

(52) U.S. Cl. ..... 439/470; 439/465; 439/906

(58) Field of Classification Search ..... 439/470, 439/445, 446, 473, 466, 465, 906
See application file for complete search history.

(56) References Cited

U.S. PATENT DOCUMENTS

| | | | | |
|---|---|---|---|---|
| 5,104,337 | A * | 4/1992 | Chow et al. | 439/470 |
| 5,788,528 | A * | 8/1998 | Orr et al. | 439/358 |
| 6,019,638 | A * | 2/2000 | Saka et al. | 439/620 |
| 6,203,362 | B1 * | 3/2001 | Tsuji | 439/470 |
| 6,364,693 | B1 * | 4/2002 | Stagg et al. | 439/467 |
| 6,475,021 | B1 * | 11/2002 | Tan et al. | 439/446 |
| 6,644,999 | B1 * | 11/2003 | Tan et al. | 439/446 |

FOREIGN PATENT DOCUMENTS

JP 01100877 4/1989

* cited by examiner

*Primary Examiner*—Hien Vu
(74) *Attorney, Agent, or Firm*—Staas & Halsey LLP

(57) ABSTRACT

A connector cover is formed by combining a first half cover and a second half cover. A cable guide is formed to have a pipe form by combining two cable half guides each having a semicircular cross section. The cable guide envelopes and guides a part of a cable leading out from the connector cover. The two cable half guides are coupled by being engaged with each other at one end, and are coupled with each other and attached detachably to the connector cover by being held between the first half cover and the second half cover at the other end.

8 Claims, 18 Drawing Sheets

CABLED CONNECTOR INCLUDING CABLE GUIDE ATTACHED DETACHABLY TO CONNECTOR COVER

BACKGROUND OF THE INVENTION

1. Field of the Invention

The present invention generally relates to a cabled connector, and more particularly, to a balanced transmission connector with a balanced transmission cable which is used for connection between parts performing a balanced transmission of data, such as connection between a computer and a server.

A cabled connector is provided with a cable extending from a backside. A balanced transmission connector with a balanced transmission cable includes multiple terminals arranged suitably for a balanced transmission, in which the balanced transmission cable extends from a backside of the balanced transmission connector.

Methods of transmitting data between a computer and a server include a common transmission method using one wire for each data, and a balanced transmission method using a pair of wires for each data so as to transmit a +signal, which is originally to be transmitted, and simultaneously, a −signal reversed but equal in magnitude to the +signal. The balanced transmission method has an advantage of not easily influenced by noises in comparison with the common transmission method, and therefore is beginning to be employed for data transmission between a computer and a server.

As shown in FIG. 1, a server 1 has a structure in which a server body 2 is accommodated in a cabinet 3, and is installed on a free access floor (a raised floor) 10. A space 5 appropriate for accommodating cables is prepared between a backside of the server body 2 and a door 4 at a backside of the cabinet 3. A plurality of cables 20 are drawn out from the free access floor 10, and connectors 21 at respective ends of the cables 20 are connected with respective connectors 6 at the backside of the server body 2. That is, the cables 20 leading out from the respective connectors 21 connected with the respective connectors 6 reach the free access floor 10 through the space 5. The door 4 at the backside of the cabinet 3 is closed so as to cover the cables 20. In this structure, a width S of the space 5 is designed to be as narrow as possible so that the server 1 has a small outside dimension.

Since a common cable has a moderate flexibility, each of the cables 20 curves moderately at a portion leading out from a backside of the connector 21 by a self-weight of the cable 20, and is adequately contained in the space 5, hardly causing a problem.

However, when the balanced transmission method is adopted, a number of wires increases approximately twice as many as a conventional number of wires. Accordingly, a balanced transmission cable 160 becomes hard, and cannot be expected to have a moderate flexibility. Therefore, the balanced transmission cable 160 is unable to curve moderately by a self-weight of the balanced transmission cable 160, and in a natural state, the balanced transmission cable 160 is unable to be contained in the space 5, but is likely to come out of the space 5, possibly causing a state in which the door 4 cannot be closed without an operator curving the balanced transmission cable 160 forcibly.

Thereupon, the balanced transmission cable 160 extending from the connector may be curved forcibly so as to extend further downward, as by the following means.

2. Description of the Related Art

FIG. 2 shows a conventional cabled connector 30 disclosed in Japanese Laid-Open Patent Application No. 1-100877. This connector 30 has a structure in which a cable-forcibly-curving means 31 is mounted beforehand on a connector cover 32. The cable-forcibly-curving means 31 forcibly curves a cable 40 leading backward from the connector 30. The cable-forcibly-curving means 31 has a structure capable of curving the cable 40 at various angles so that the cable 40 can be drawn out selectively in various directions.

In the structure of the cable-forcibly-curving means 31, ball pairs 34 for hooking the curved cable 40 are arranged at a plurality of positions along a circular-arc cover 33, making the structure considerably large in size.

Besides, when a transmission rate of data is as high as 1 Gbit per second, a signal wavelength becomes short so that an electromagnetic wave generated in the connector becomes likely to leak out of the connector. Therefore, measures need to be taken against electromagnetic interference (EMI) for the connector. However, EMI measures are not sufficiently taken for the structure of the connector 30.

SUMMARY OF THE INVENTION

It is a general object of the present invention to provide an improved and useful cabled connector in which the above-mentioned problems are eliminated.

A more specific object of the present invention is to provide a cabled connector which can adapt to miniaturization, facilitate assembly, and easily deal with differences in diameter of the cable and differences in angle at which the cable is drawn out.

In order to achieve the above-mentioned objects, there is provided according to one aspect of the present invention a cabled connector with a cable extending from a connector cover, the cabled connector including, a cable guide being an independent member from the connector cover, having a pipe form accommodating the cable therethrough, and enveloping and guiding a part of the cable leading out from the connector cover, wherein the cable guide is attached detachably to the connector cover.

According to the present invention, since the cable guide has a pipe form, the cabled connector is small, compared with a conventional cabled connector. Besides, the cable guide is an independent member from the connector cover, and is attached detachably to the connector cover. Therefore, varieties of the cable guide prepared to have different forms can deal with various cables and requirements for curving the cable by various curvatures, only with one type of the connector cover.

Additionally, in the cabled connector according to the present invention, the connector cover may include a first half cover and a second half cover combined with each other, the cable guide may include two cable half guides combined with each other, each of the cable half guides having a semicircular cross section, and the two cable half guides may be coupled by being engaged with each other at end parts thereof, and be coupled with each other and attached detachably to the connector cover by being held between the first half cover and the second half cover at base parts of the two cable half guides.

According to the present invention, the two cable half guides can be coupled at the end parts without using a screw. At the base parts, the two cable half guides are coupled to form the cable guide and attached detachably to the connector cover, in the course of coupling the first half cover and the second half cover. Thereby, it becomes unnecessary to only couple the two cable half guides, or to only attach the cable guide to the connector cover. Thus, the cabled connector can be assembled easily.

Additionally, in the cabled connector according to the present invention, a part attaching the cable guide to the connector cover may be arranged symmetrical about a cable exit of the connector cover so that the cable guide is capable of being attached to the connector cover with an end part of the cable guide being turned in a different direction.

According to the present invention, simply by attaching the cable guide in a different direction, the cabled connector can be connected properly to a variously directed opponent connector.

Additionally, in the cabled connector according to the present invention, the connector cover may include a first half cover and a second half cover combined with each other, the first half cover and the second half cover may include respective wall portions confronting each other when the first half cover and the second half cover are combined, and a portion of the cable guide at a base part thereof may be engaged with receding portions formed limitedly within respective ranges of widths of the wall portions.

According to the present invention, the receding portions formed limitedly within the respective widths of the wall portions are used for engaging the portion of the cable guide at the base part. Therefore, even when the cable guide is not attached, since the receding portions for engaging the portion of the cable guide do not reach an inside part of the connector, the connector cover still exhibits an excellent shielding property.

Other objects, features and advantages of the present invention will become more apparent from the following detailed description when read in conjunction with the accompanying drawings.

DETAILED DESCRIPTION OF THE PREFERRED EMBODIMENTS

A description will now be given, with reference to the drawings, of embodiments according to the present invention.

Figure 1:
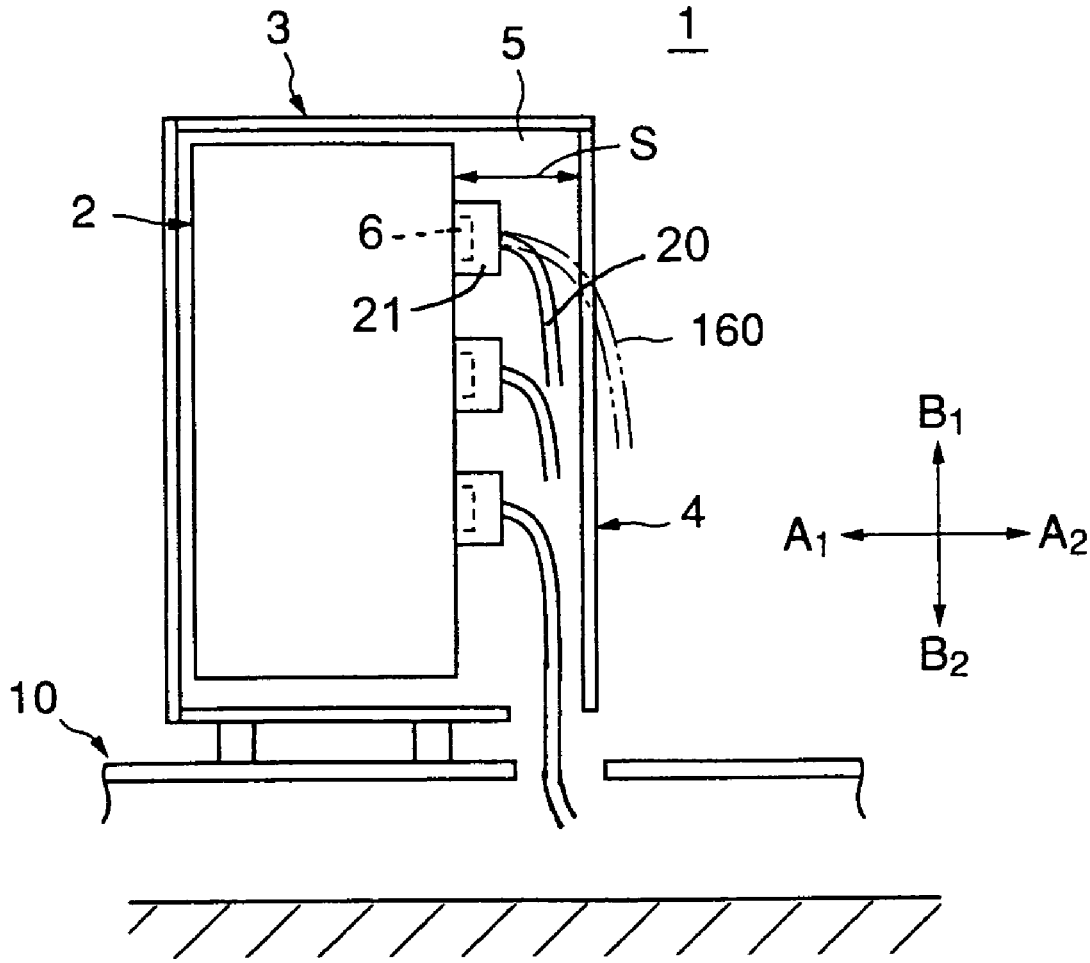
FIG.1 PRIOR ART
FIG. 1 shows a state of cables at a backside of a server.
Figure 2:
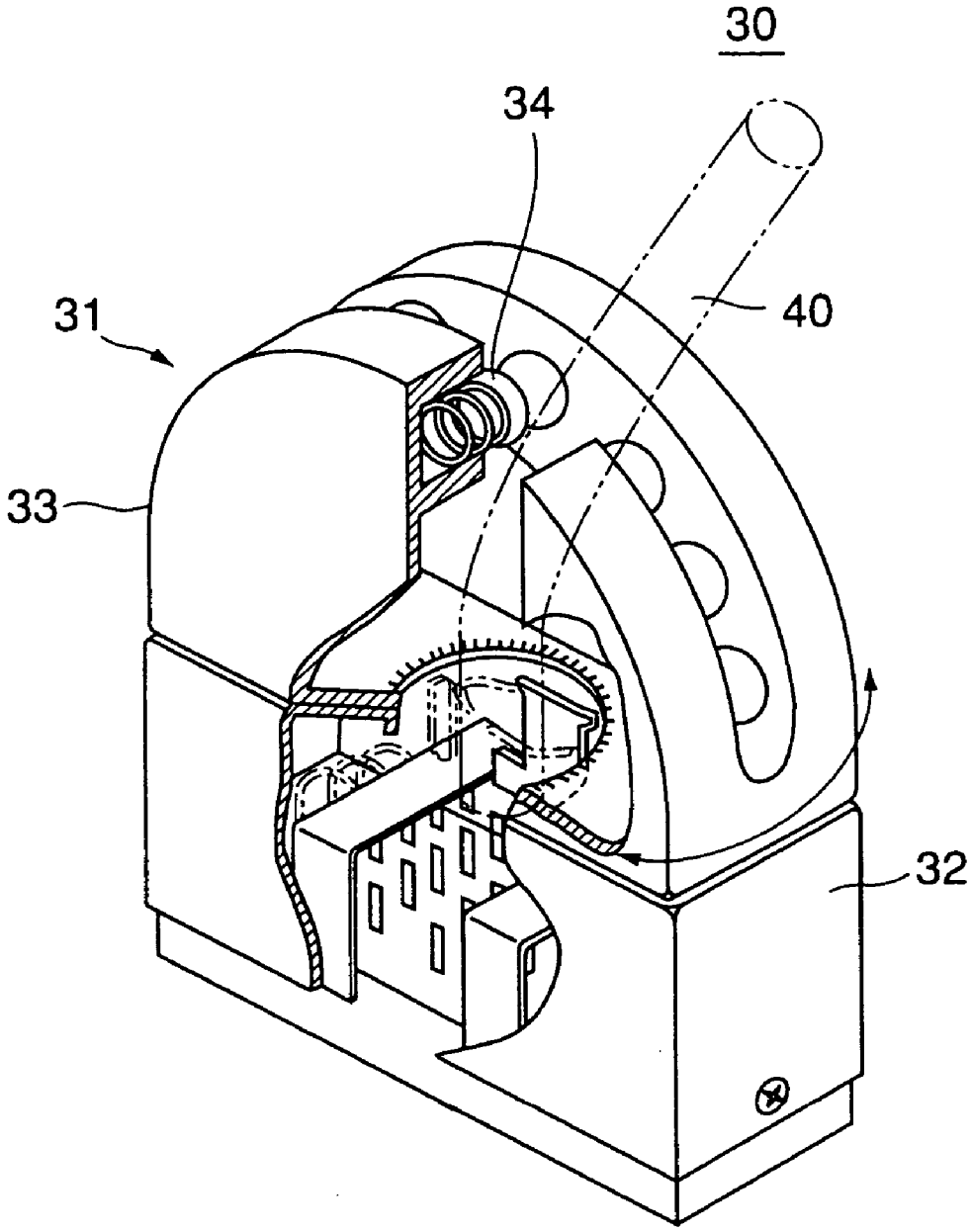
FIG.2 PRIOR ART
FIG. 2 shows a conventional cabled connector.
Figure 3:
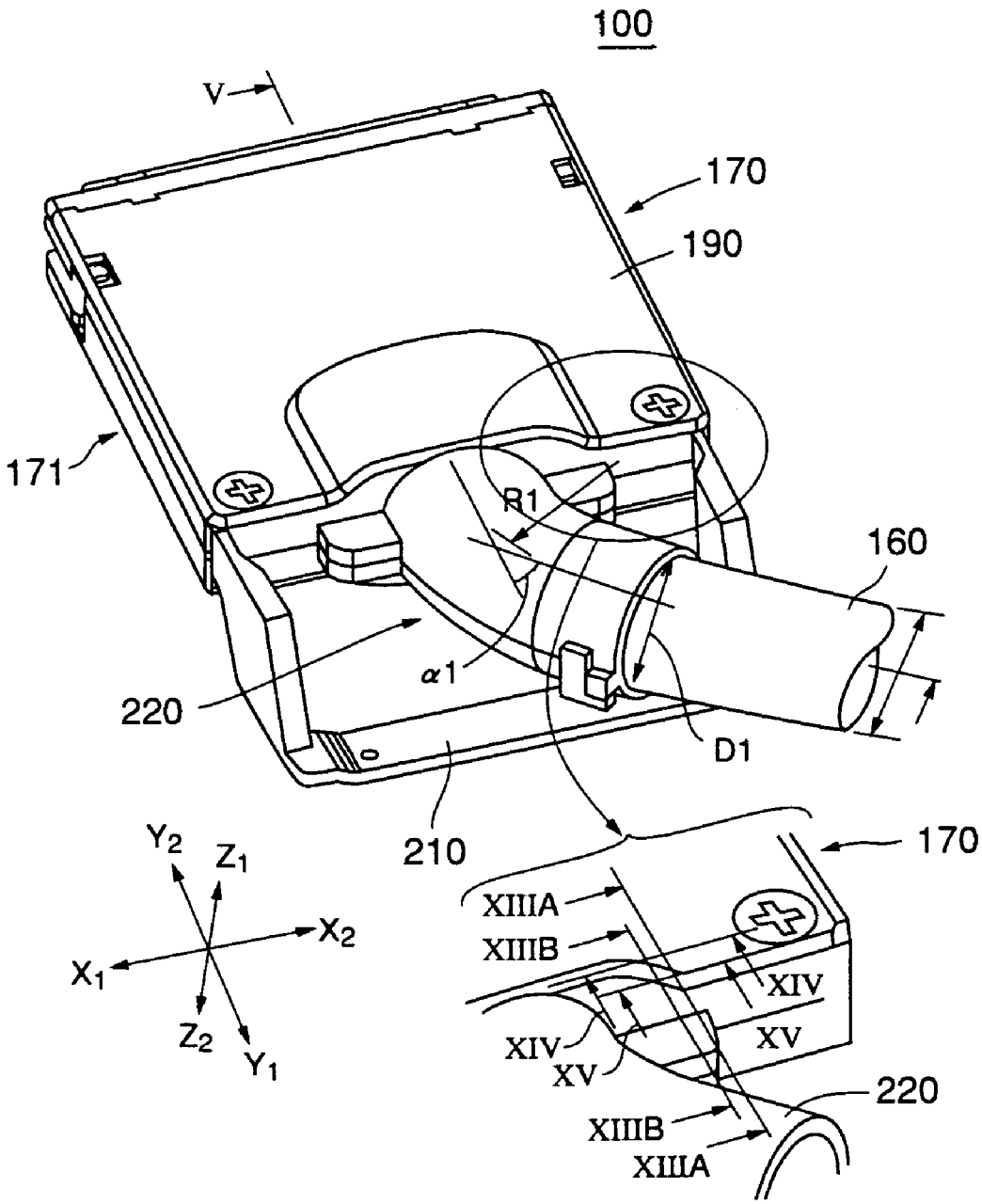
FIG. 3 is a perspective rear view of a balanced transmission connector with a balanced transmission cable according to an embodiment of the present invention.
Figure 4:
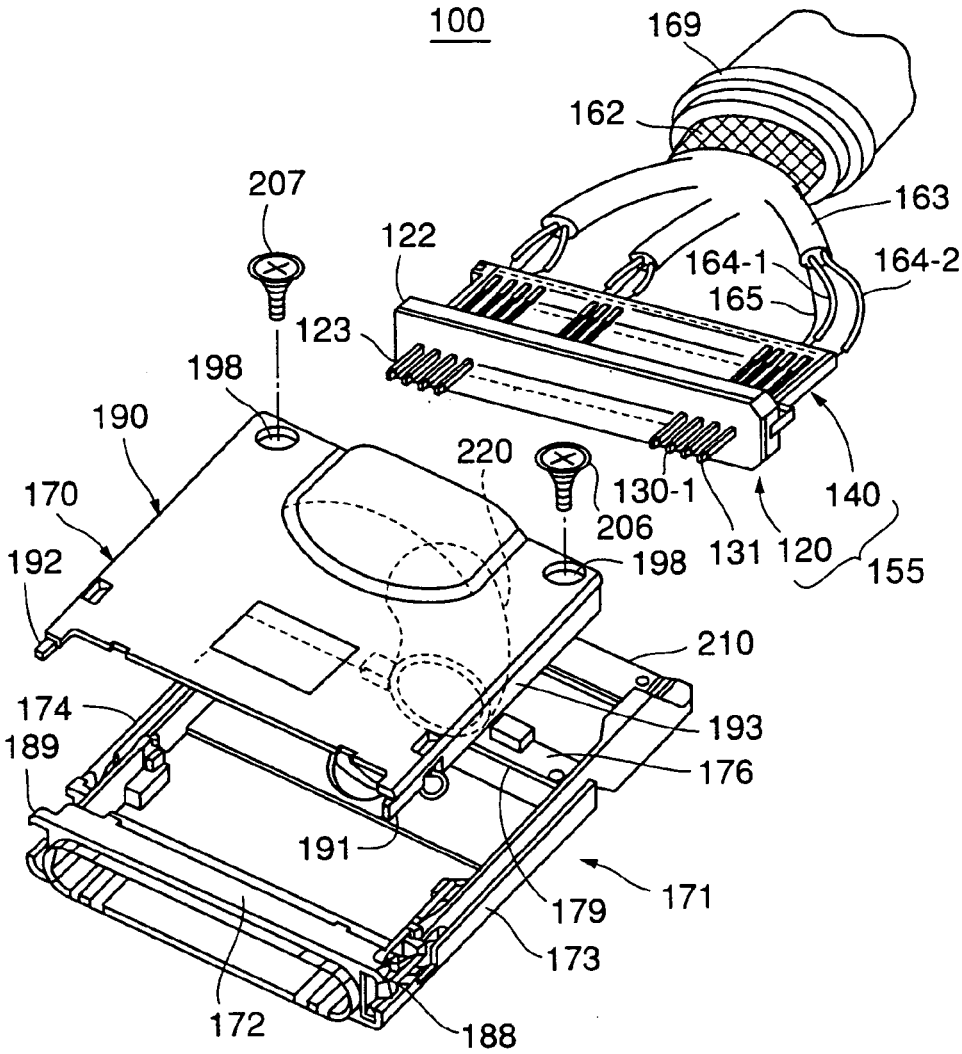
FIG. 4 is an exploded perspective front view of the balanced transmission connector shown in FIG. 3.
Figure 5:
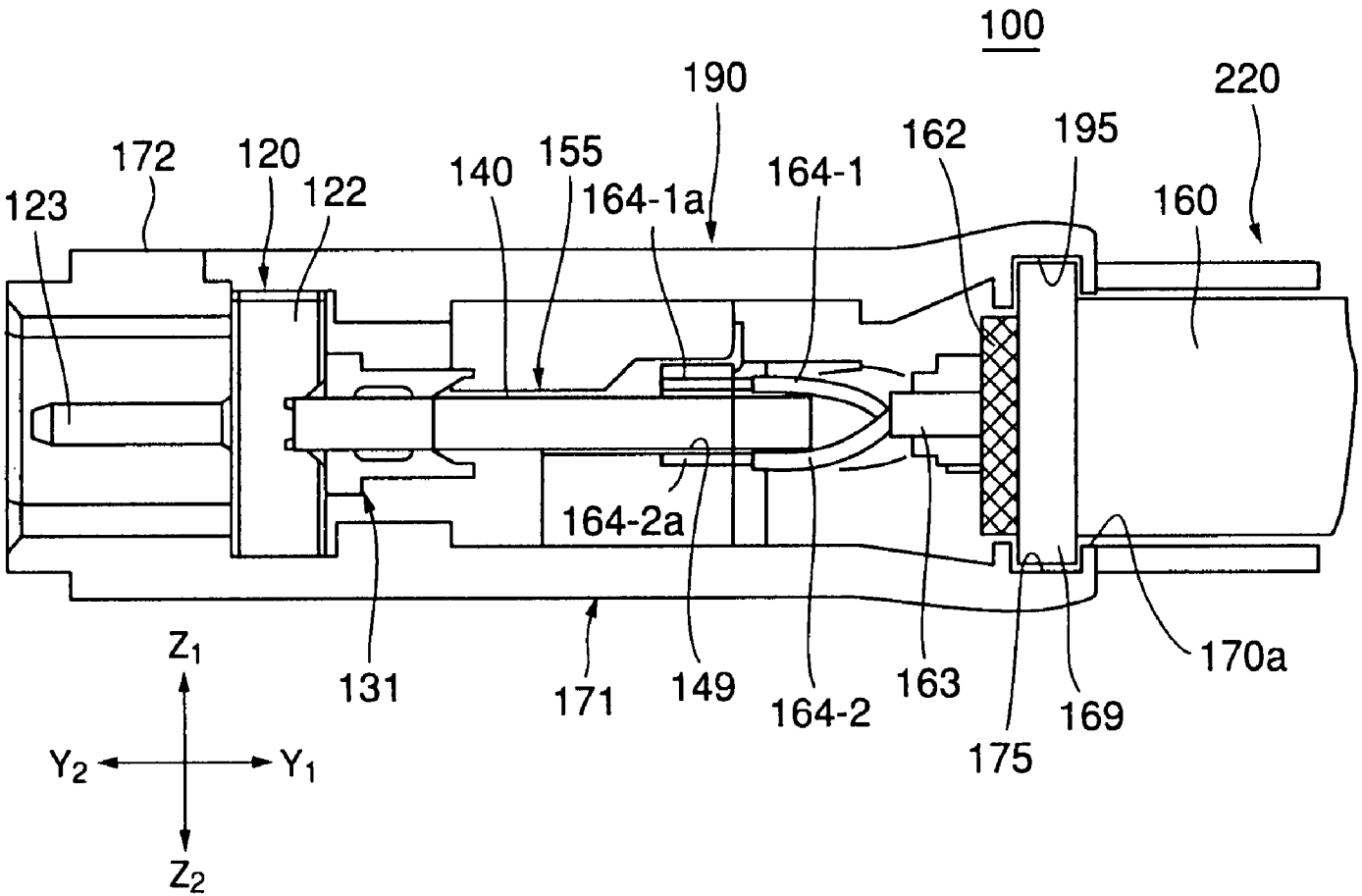
FIG. 5 is a cross-sectional view taken along a line V—V in FIG. 3, showing an internal structure of the balanced transmission connector shown in FIG. 3.

FIG. 3 is a perspective rear view of a balanced transmission connector 100 with a balanced transmission cable according to an embodiment of the present invention. FIG. 4 is an exploded perspective front view of the balanced transmission connector 100. FIG. 5 is a cross-sectional view taken along a line V—V in FIG. 3. The balanced transmission connector 100 is provided on an end of the balanced transmission cable 160. That is, the balanced transmission cable 160 extends from a backside of the balanced transmission connector 100. X1–X2 indicates a width direction of the connector 100; Y1–Y2 indicates a longitudinal direction of the connector 100; and Z1–Z2 indicates a height direction of the connector 100.

As shown in FIG. 3, FIG. 4 and FIG. 5, the connector 100 comprises a balanced transmission plug body 120, and a repeating substrate 140 soldered and fixed at a back end (Y1-direction end) of the plug body 120, the balanced transmission cable 160 connected to the Y1-direction end of the repeating substrate 140, a shield cover assembly (a connector cover) 170 covering the plug body 120, the repeating substrate 140, and a part of the cable 160, and a pipe-form cable guide 220. The cable guide 220 restrains and guides a part of the cable 160 extending in the Y1-direction from the shield cover assembly 170 so as to curve the cable 160 forcibly in a predetermined direction by a predetermined curvature, thereby determining a drawing-out direction in which the cable 160 is drawn out from the backside of the connector 100. The cable guide 220 is attached detachably to the shield cover assembly 170. There are varieties of the cable guide 220 which have different inside diameters and different drawing-out angles at which the cable 160 is drawn out.

Figure 6:
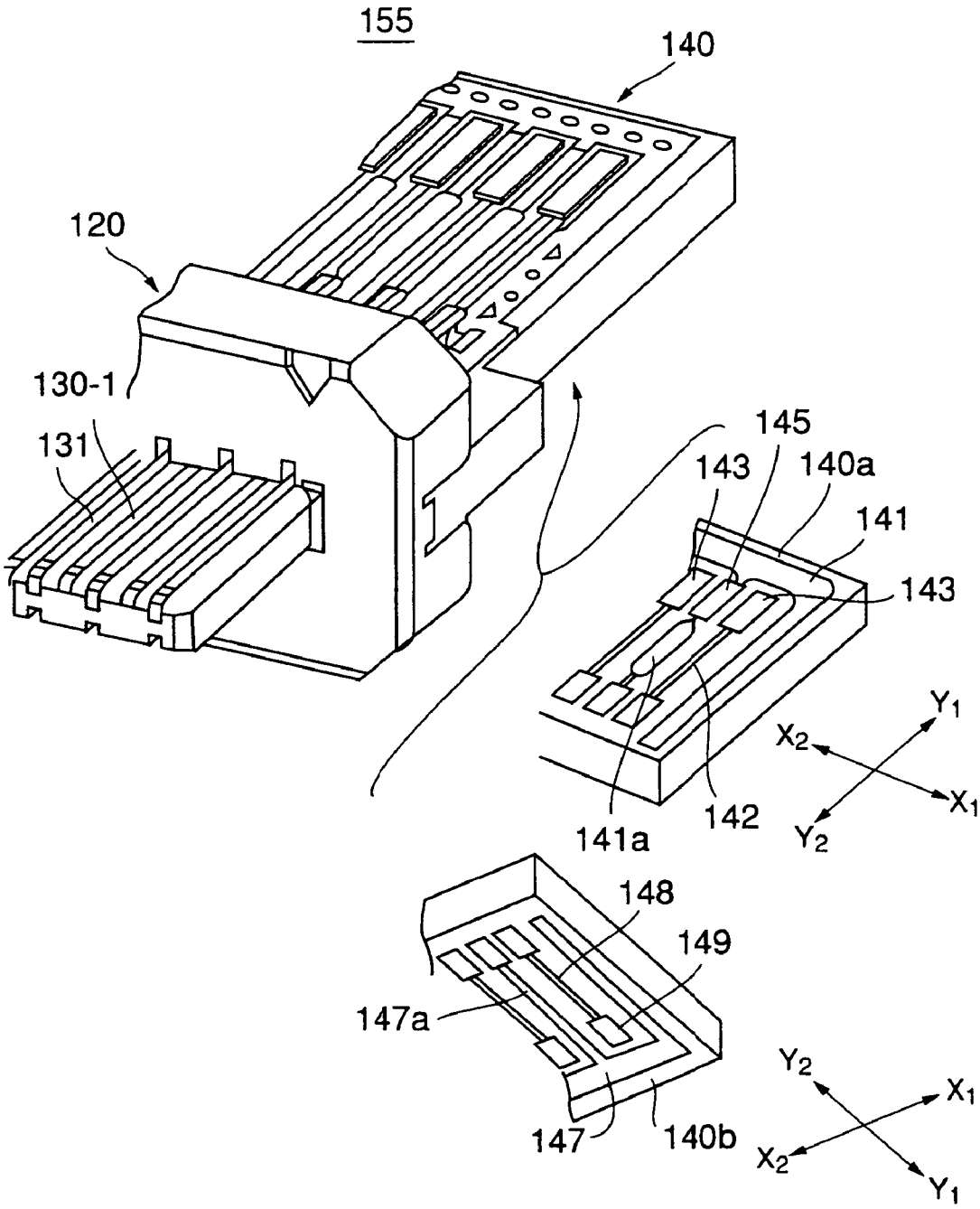
FIG. 6 is a magnified view of a balanced transmission plug-body/repeating-substrate assembly shown in FIG. 4.

The plug body 120 and the repeating substrate 140 are combined so as to form a balanced transmission plug-body/repeating-substrate assembly 155, as magnified in FIG. 6. Various wires drawn out from the balanced transmission cable 160 (shown in FIG. 8) are spread in the X1–X2 direction, and are soldered to the repeating substrate 140. The pipe-form cable guide 220 envelops, restrains and guides the end part of the cable 160. The shield cover assembly 170 has a structure in which a first shield half cover 171 and a second shield half cover 190 are combined. A pull lever 210 is pulled in the Y1 direction upon disconnecting the connector. The pull lever 210 is substantially U-shaped, and arm portions thereof at both sides are inserted into the first shield half cover 171 so as to be attached therewith. Thus, the pull lever 210 is provided so as to project from the shield cover assembly 170 in the Y1 direction. The cable guide 220 has a size not interfering with the pull lever 210, and is mounted on the shield cover assembly 170 so as to coincide with a cable-path opening (a cable exit) 170*a* formed at a Y1-end of the shield cover assembly 170.

The connector 100 is assembled by containing the balanced transmission plug-body/repeating-substrate assembly 155, connected with the balanced transmission cable 160, between the first shield half cover 171 and the second shield half cover 190, and by holding and fixing an end portion of the cable guide 220 between the first shield half cover 171 and the second shield half cover 190. For the sake of convenience in illustration, FIG. 4 shows the cable guide 220 not in relation with the cable 160.

Figure 7:
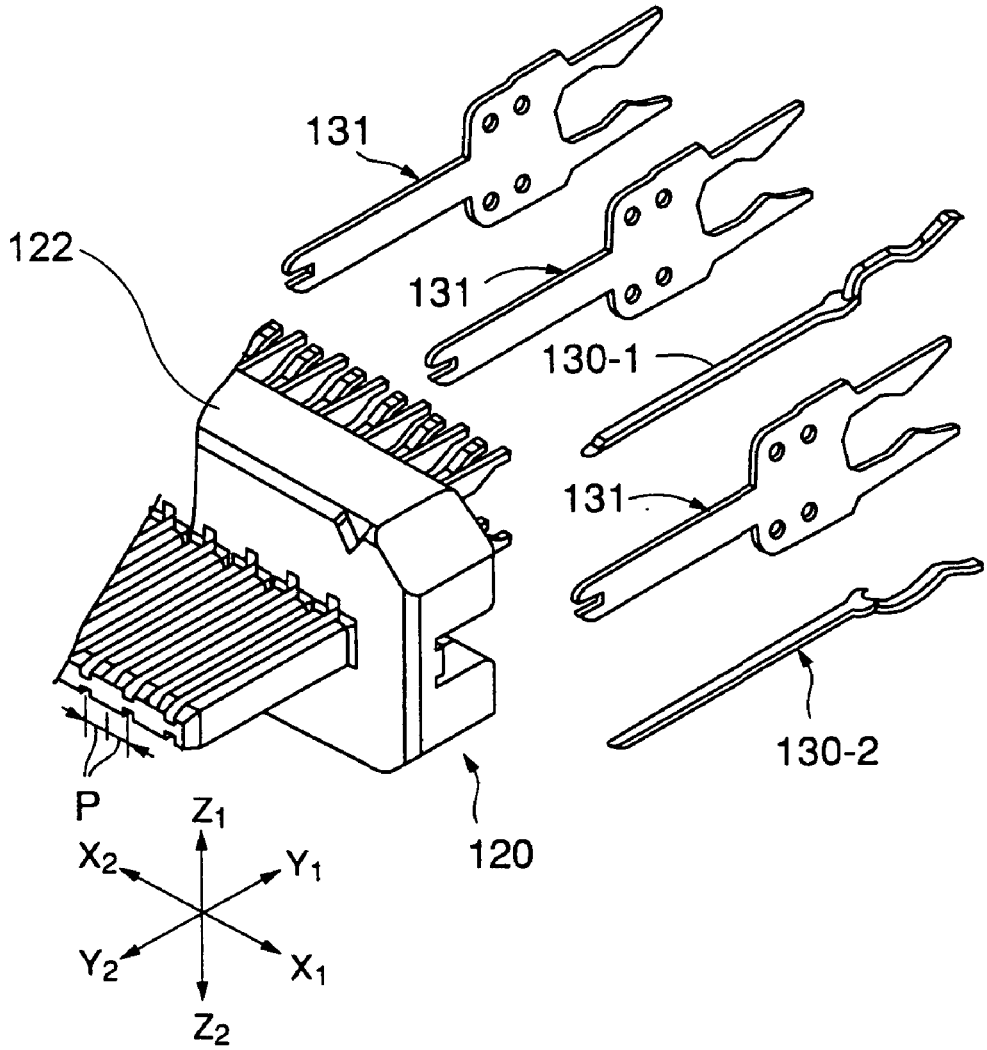
FIG. 7 shows a balanced transmission plug body with contacts.

As magnified in FIG. 7, the balanced transmission plug body 120 has a structure in which a pair of first and second signal contacts 130-1 and 130-2, and plate-form ground contacts 131 are incorporated alternately at a predetermined pitch p in the X1–X2 direction into a block part 122 which is a molded component made of a synthetic resin.

As shown in FIG. 6, a pectinate ground pattern 141 is formed on an upper surface 140*a* of the repeating substrate 140, and a wiring pattern 142 is formed between adjacent tooth patterns 141*a*. A pectinate ground pattern 147 is formed on an undersurface 140*b* of the repeating substrate 140, and a wiring pattern 148 is formed between adjacent tooth patterns 147*a*.

Figure 8:
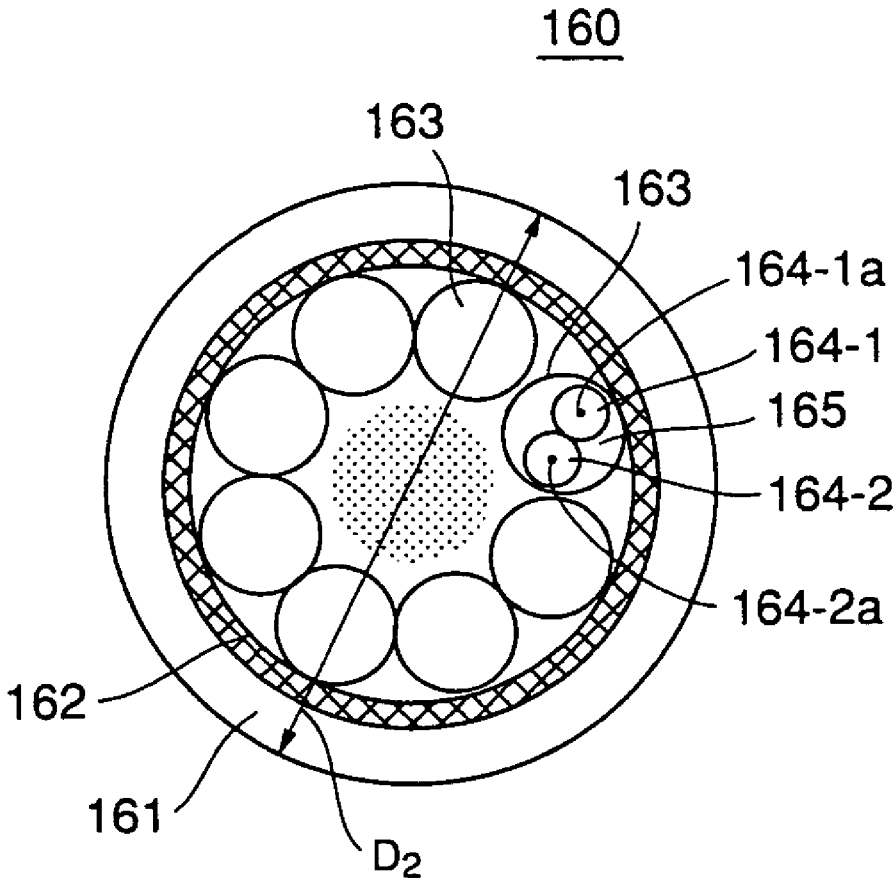
FIG. 8 is a cross-sectional view of the balanced transmission cable.

As shown in FIG. 4 and FIG. 8, the balanced transmission cable 160 has a structure in which a plurality of wires 163 are arranged inside an outer covering part 161 and a wire-group shield network 162, as viewed in a cross-section perpendicular to an axis of the balanced transmission cable 160. An end portion of the cable 160 is fastened by a ring member 169. Each of the wires 163 includes a pair of first and second covered leads 164-1 and 164-2 for balanced signal transmission, and a drain wire 165. An end portion of the wire-group shield network 162 and an end portion of each of the wires 163 are processed. As shown in FIG. 4, FIG. 5 and FIG. 6, a lead 164-1*a* of the first covered lead 164-1, the drain wire 165, a lead 164-2*a* of the second covered lead 164-2, are soldered to a first signal-line pad 143, a drain-line pad 145, and a second signal-line pad 149, of the repeating substrate 140, respectively.

Since the balanced transmission cable 160 includes a large number of the wires 163, the balanced transmission cable 160 is hard, and does not have a sufficient flexibility.

Next, a description will be given, also with reference to FIG. 9, FIG. 10 and FIG. 11, of the shield cover assembly 170.

Figure 9:
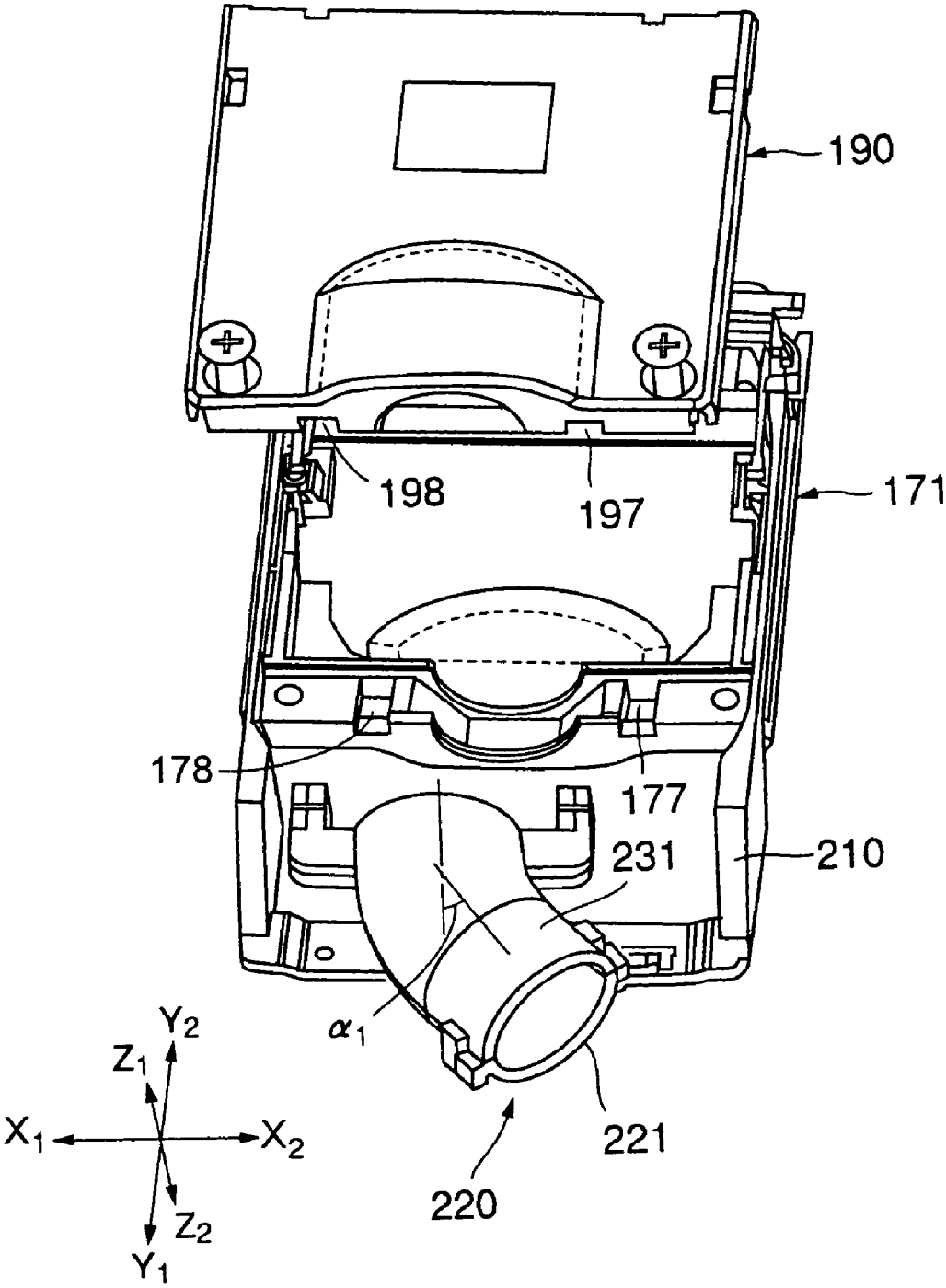
FIG. 9 is an exploded perspective rear view of a shield cover assembly and a cable guide.

FIG. 9 is an exploded perspective rear view of the shield cover assembly 170 and the cable guide 220. FIG. 10 is a perspective rear view of the first shield half cover 171. FIG. 11 is an inverted perspective rear view of the second shield half cover 190.

As shown in FIG. 3, FIG. 4, FIG. 5 and FIG. 9, especially in FIG. 4, the first shield half cover 171 and the second shield half cover 190 are coupled by locking Y2-end projecting portions 191 and 192 of the second shield half cover 190 with receiving portions 188 and 189 of the first shield half cover 171, respectively, and by fixing both sides in the X1–X2 direction at a Y1-end of the second shield half cover 190 to the first shield half cover 171 with screws 206 and 207.

The first and second shield half covers 171 and 190 are zinc die castings which are conductive and nonmagnetic.

Figure 10:
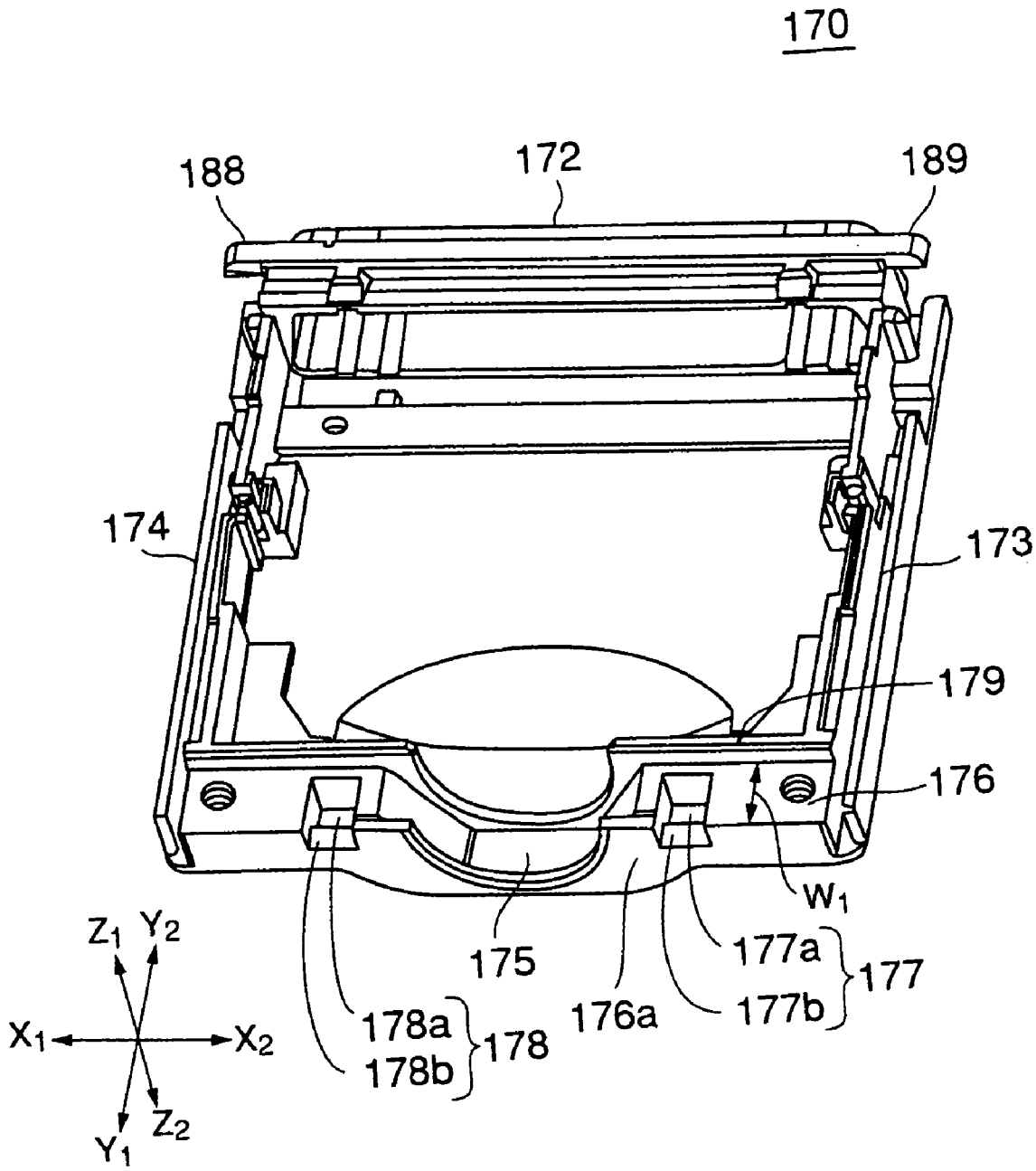
FIG. 10 is a perspective rear view of a first shield half cover.

As shown in FIG. 4, FIG. 9 and FIG. 10, the first shield half cover 171 includes a frame portion 172 at a Y2-end, includes double wall portions 173 and 174 extending in the Y1–Y2 direction at X1–X2 sides, includes a substantially semicircular receding portion 175 in the center at a Y1-end for fixing the cable, and includes a wall portion 176 having a large width W1 and extending in the X1–X2 direction from the receding portion 175 to the wall portions 173 and 174, and includes an auxiliary wall portion 179 rising inside (in the Y2-direction) the wall portion 176. The frame portion 172 includes the receiving portions 188 and 189 at both sides in the X1–X2 direction.

Figure 13A:
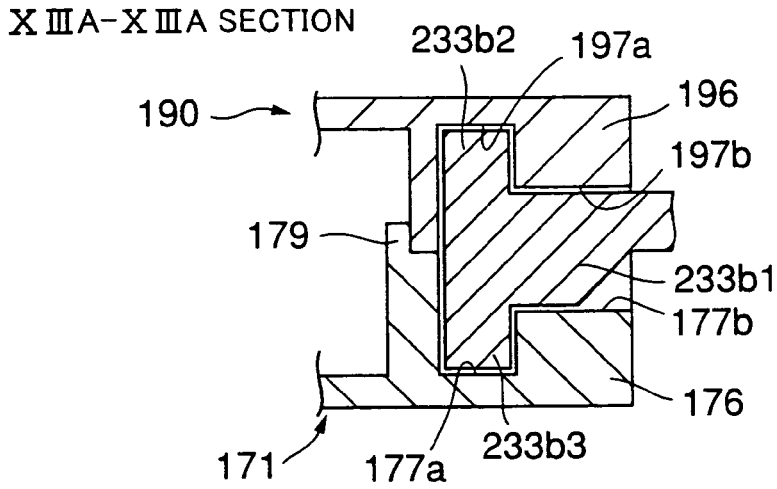
FIG. 13A is a cross-sectional view taken along a line XIIIA—XIIIA in FIG. 3, showing a structure for fixing the cable guide to the shield cover assembly.
Figure 13B:
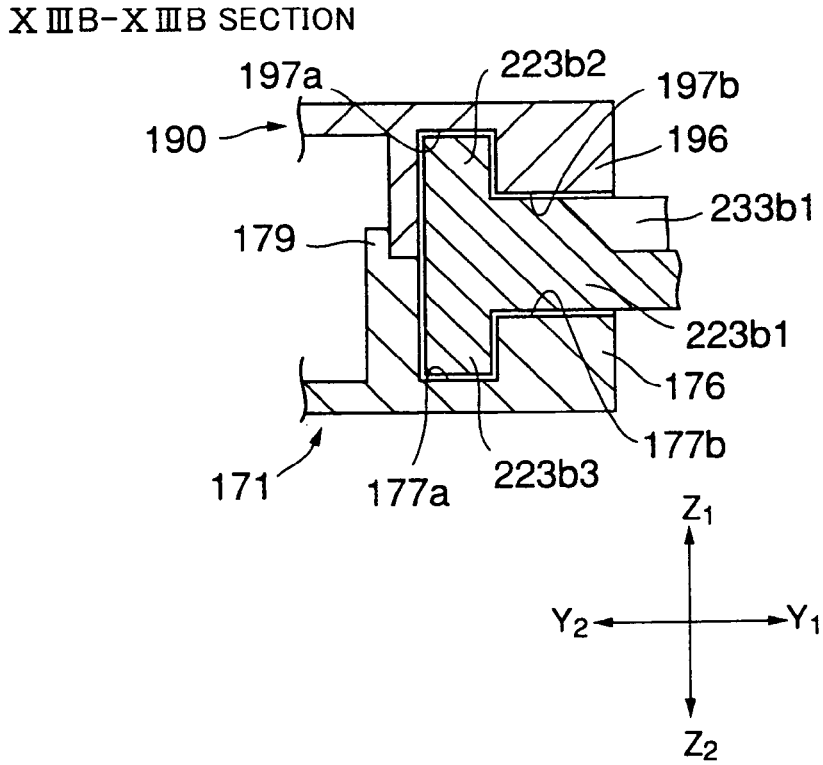
FIG. 13B is a cross-sectional view taken along a line XIIIB—XIIIB in FIG. 3, showing the structure for fixing the cable guide to the shield cover assembly.

The wall portion 176 includes stepped receding portions, or recesses, 177 and 178 for fixing the cable guide 220. The stepped receding portions 177 and 178 are formed at positions symmetrical about the receding portion 175. The stepped receding portions 177 and 178 are formed by deep receding portions 177*a* and 178*a*, and shallow receding portions 177*b* and 178*b*, respectively (as also shown in FIG. 13A and FIG. 13B). The shallow receding portions 177*b* and 178*b* reach an outer surface 176*a* of the wall portion 176 in the Y1-direction. The deep receding portions 177*a* and 178*a* are formed limitedly within a range of the width of the wall portion 176 so as not to reach an inner surface of the wall portion 176 in the Y2-direction.

Figure 11:
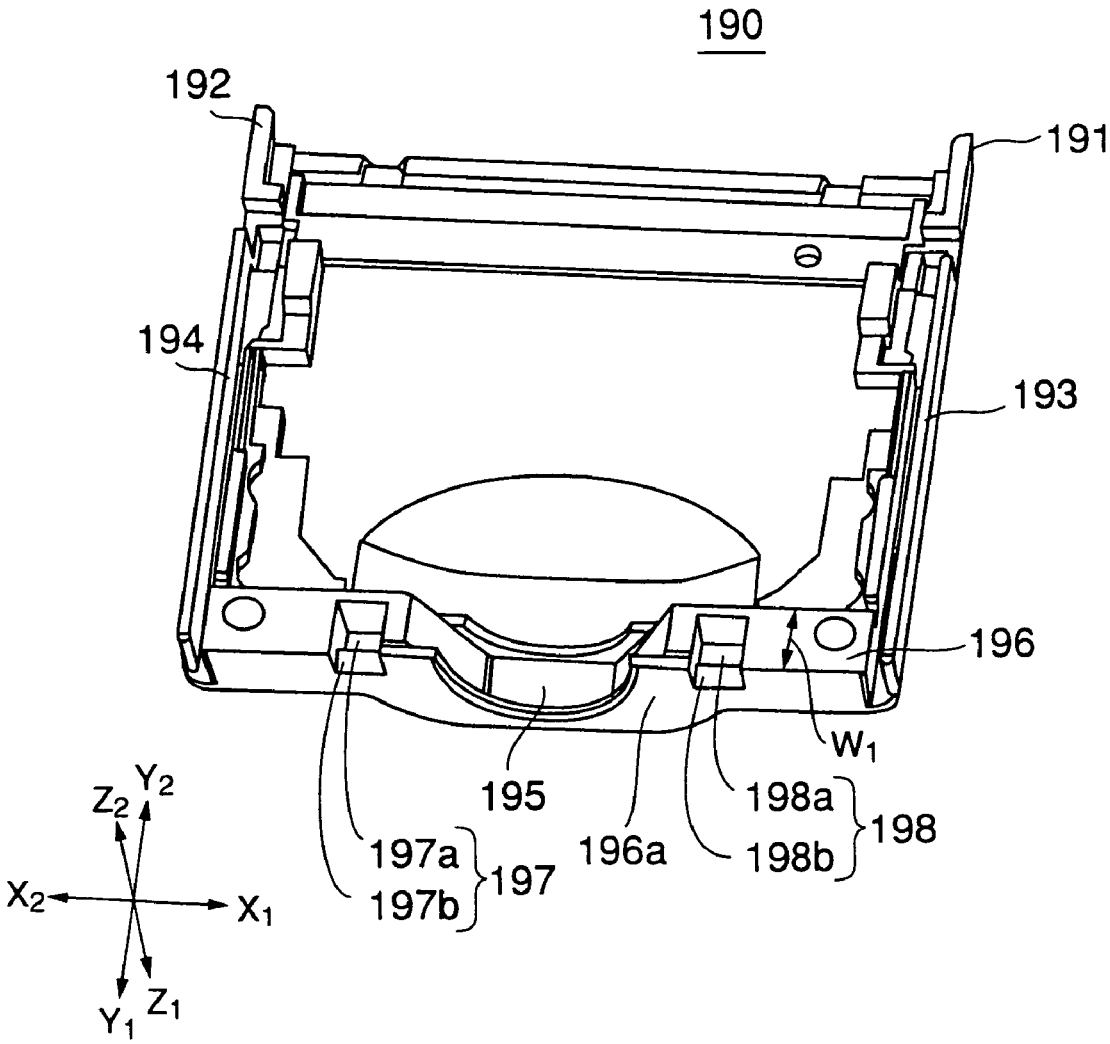
FIG. 11 is an inverted perspective rear view of a second shield half cover.
Figure 12:
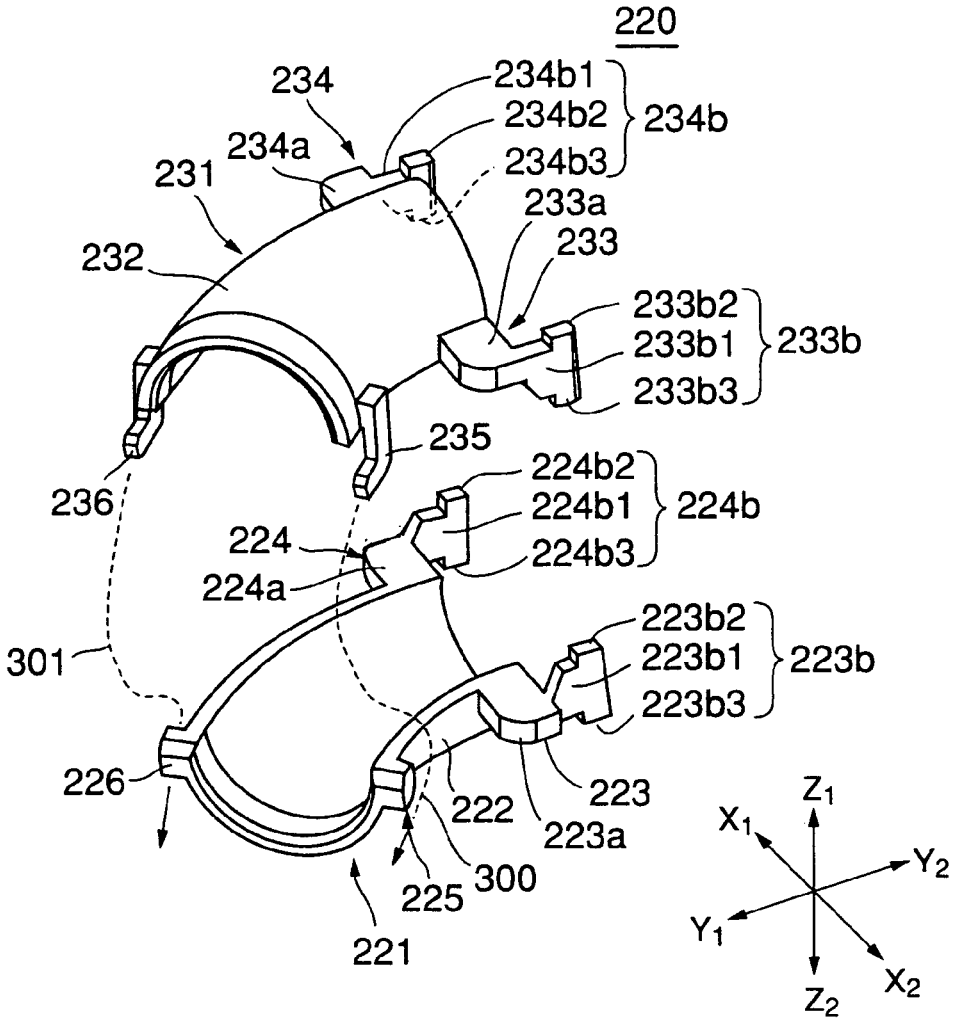
FIG. 12 is an exploded perspective view of the cable guide.

As shown in FIG. 4, FIG. 9, and FIG. 11, the second shield half cover 190 includes the projecting portions 191 and 192 at both sides in the X1–X2 direction at the Y2-end, and includes double wall portions 193 and 194 extending in the Y1–Y2 direction at X1–X2 sides, includes a substantially semicircular receding portion 195 in the center at the Y1-end for fixing the cable, and includes a wall portion 196 having the large width W1 and extending in the X1–X2 direction from the receding portion 195 to the wall portions 193 and 194.

The wall portion 196 includes stepped receding portions 197 and 198 for fixing the cable guide 220. The stepped receding portions 197 and 198 are formed at positions that are symmetrical about the receding portion 195 and correspond to the stepped receding portions 177 and 178. The stepped receding portions 197 and 198 are formed by deep receding portions 197*a* and 198*a*, and shallow receding portions 197*b* and 198*b*, respectively (as also shown in FIG. 13A and FIG. 13B). The shallow receding portions 197*b* and 198*b* reach an outer surface 196*a* of the wall portion 196 in the Y1-direction. The deep receding portions 197*a* and 198*a* are formed limitedly within the range of the width of the wall portion 196 so as not to reach an inner surface of the wall portion 196 in the Y2-direction.

Next, a description will be given, also with reference to FIG. 12 to FIG. 15, of the cable guide 220.

The cable guide 220 has a structure in which a first half guide (a first cable half guide) 221 and a second half guide (a second cable half guide) 231 are coupled. The cable guide 220 has a pipe form having a size with an inside diameter D1 (see FIG. 14) corresponding to a diameter D2 (see FIG. 8) of the cable 160, and is curved by a radius R1 of curvature (see FIG. 3) in an X-Y plane so that the cable 160 is drawn out at a drawing-out angle of $\alpha 1$. This cable guide 220 envelops the end part of the cable 160, restrains the cable 160, and curves the cable 160 according to the curvature of the cable guide 220 so as to draw out the cable 160 in a predetermined direction.

The first half guide 221 is formed by a curved semicylindrical body 222, locking portions 223 and 224 jutting from a Y2-edge of the body 222 in the X2-direction and the X1-direction, respectively, and protruding portions 225 and 226 jutting from a Y1-edge of the body 222 substantially in the X2-direction and the X1-direction, respectively. The locking, or catching, portions 223 and 224 are formed by flange portions 223*a* and 224*a* jutting from the body 222 in the X2-direction and the X1-direction, respectively, and locking hooks 223*b* and 224*b* jutting from the flange portions 223*a* and 224*a*, respectively, in the Y2-direction. The locking hooks 223*b* and 224*b* have transverse-T shapes, and includes transverse legs 223*b*1 and 224*b*1, hook portions 223*b*2 and 224*b*2 projecting in the Z1-direction, and hook portions 223*b*3 and 224*b*3 projecting in the Z2-direction, respectively.

The second half guide 231 is formed by a curved semicylindrical body 232, locking, or catching, portions 233 and 234 jutting from a Y2-edge of the body 232 in the X2-direction and the X1-direction, respectively, and L-shaped hook portions 235 and 236 jutting from a Y1-edge of the body 232 substantially in the X2-direction and the X1-direction, respectively. The locking portions 233 and 234 are formed by flange portions 233*a* and 234*a* jutting from the body 232 in the X2-direction and the X1-direction, respectively, and locking hooks 233*b* and 234*b* jutting from the flange portions 233*a* and 234*a*, respectively, in the Y2-direction. The locking hooks 233*b* and 234*b* have transverse-T shapes, and includes transverse legs 233*b*1 and 234*b*1, hook portions 233*b*2 and 234*b*2 projecting in the Z1-direction, and hook portions 233*b*3 and 234*b*3 projecting in the Z2-direction, respectively.

The first half guide 221 and the second half guide 231 are attached detachably to the shield cover assembly 170 as the cable guide 220 guiding the cable 160, as follows: upon completion of connecting the balanced transmission cable 160 to the balanced transmission plug-body/repeating-substrate assembly 155, a portion near the end of the cable 160 is forcibly curved according to the curvature of the cable guide 220, and a lower half of this curved portion of the cable 160 is contained in the gutter-form first half guide 221; subsequently, the second half guide 231 is inclined downward at a Y1-end thereof, and the hook portions 235 and 236 are locked with the protruding portions 225 and 226, respectively, as indicated by dashed lines 300 and 301; then, a Y2-end of the second half guide 231 is brought down so that the body 232 covers an upper half of the curved portion of the cable 160, and the locking portions 233 and 234 are coupled with the locking portions 223 and 224, respectively (see FIG. 14); a portion of the coupled locking portions 233 and 223 in the Z2-direction is engaged with the stepped receding portion, or recess, 177 of the first shield half cover 171, and a portion of the coupled locking portions 234 and 224 in the Z2-direction is engaged with the stepped receding portion, or recess, 178s of the first shield half cover 171; thereafter, the second shield half cover 190 is fixed to the first shield half cover 171.

That is, the first half guide 221 and the second half guide 231 are coupled by the hook portions 235 and 236 locking the protruding portions 225 and 226, respectively, at the Y1-end (at an end part), and are held between the first shield half cover 171 and the second shield half cover 190 at the Y2-end (at a base part) in the course of fixing the second shield half cover 190 to the first shield half cover 171; the first half guide 221 and the second half guide 231 are thus combined and attached detachably to the shield cover assembly 170. Therefore, the first half guide 221 and the second half guide 231 are coupled without using a screw, and thus can be assembled easily and efficiently, compared with a structure in which first and second half guides are coupled by screws at both ends.

Figure 14:
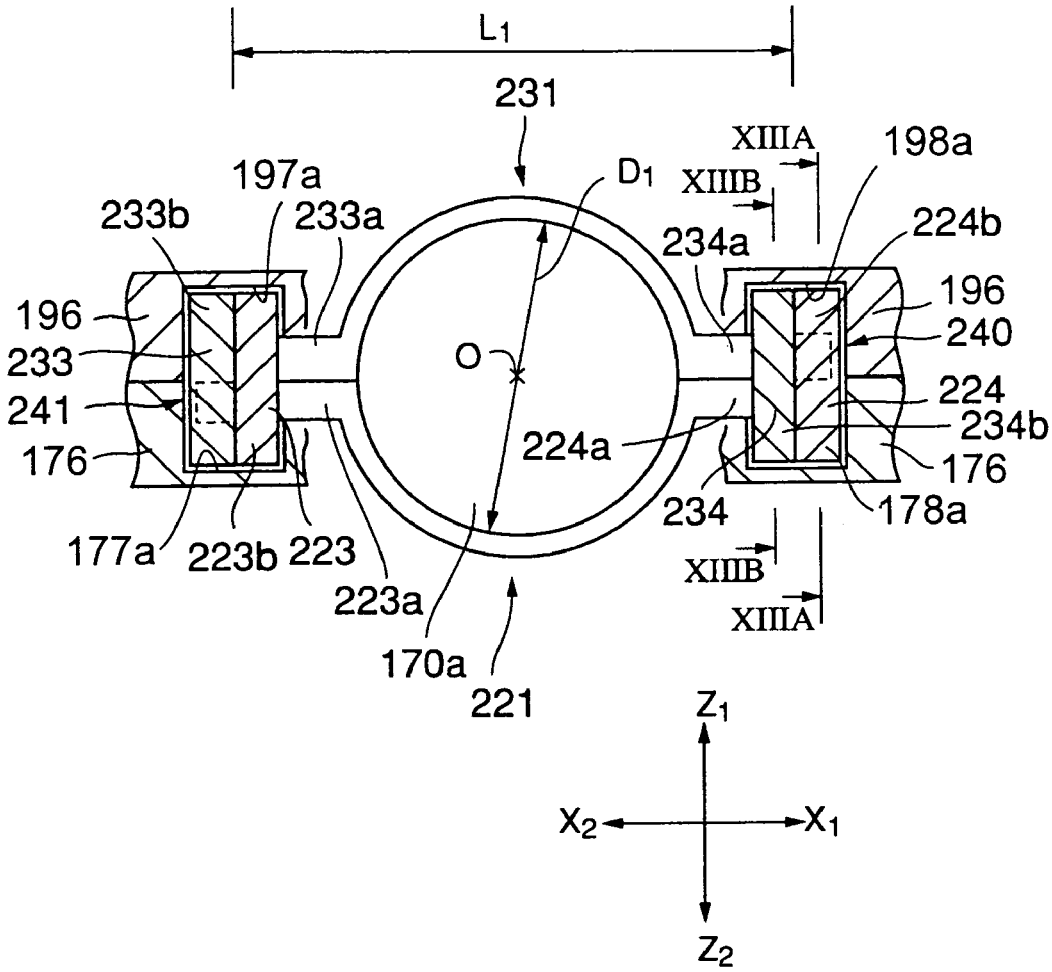
FIG. 14 is a cross-sectional view taken along a line XIV—XIV in FIG. 3, showing the structure for fixing the cable guide to the shield cover assembly.
Figure 15:
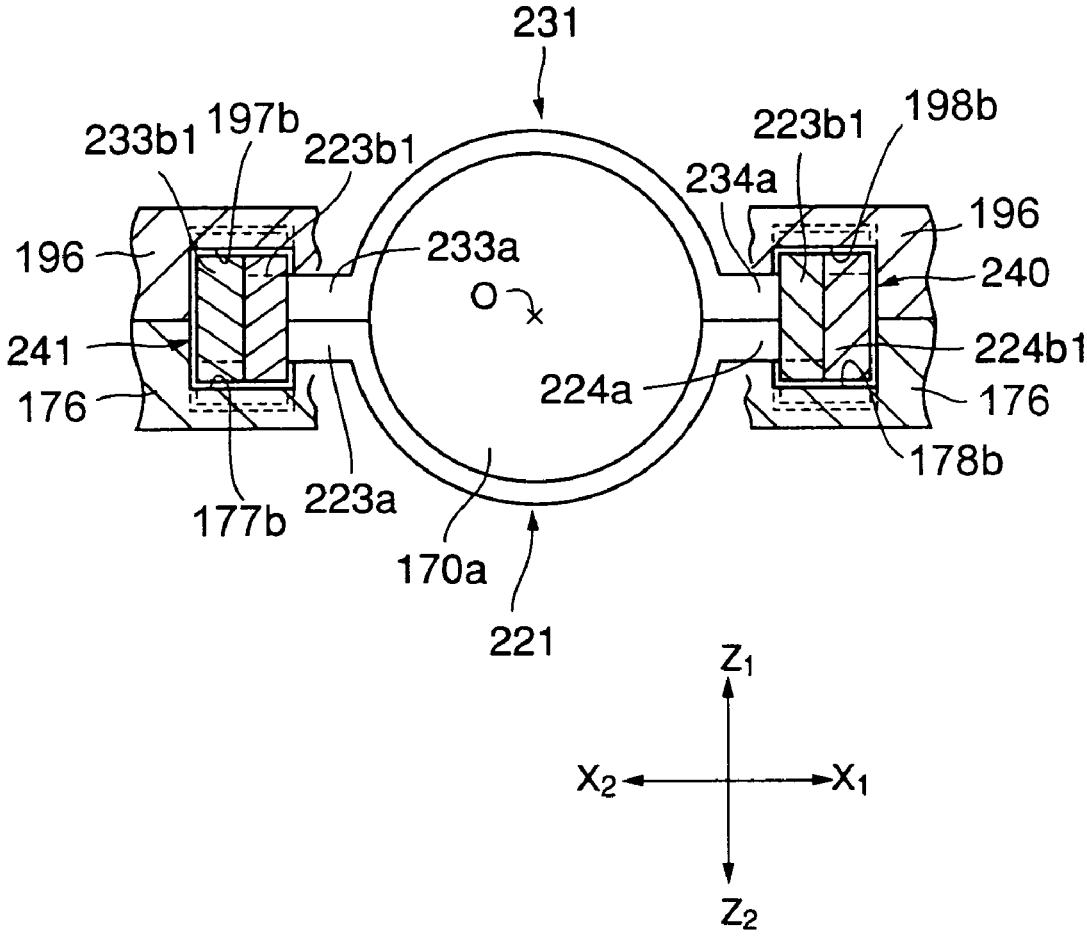
FIG. 15 is a cross-sectional view taken along a line XV—XV in FIG. 3, showing the structure for fixing the cable guide to the shield cover assembly.

Besides, when the first half guide 221 and the second half guide 231 are confronted at the Z2-end, the locking portions 233 and 223 are coupled side by side in the X1–X2 direction, and the locking portions 234 and 224 are coupled side by side in the X1–X2 direction, as shown in FIG. 14. In this coupled state, the first half guide 221 and the second half guide 231 are not fixed. When these coupled portions are locked in respective inner portions of spaces 240 and 241 each having a narrow entrance, the spaces 240 and 241 being formed between the stepped receding portions 178/177 and the vertically opposing stepped receding portions 198/197, as shown in FIG. 13A, FIG. 13B, FIG. 14 and FIG. 15, the Y2-end portion of the cable guide 220 guiding the cable 160 is fixed to the shield cover assembly 170, with freedom in the X1–X2 direction, freedom in the Z1–Z2 direction, and freedom in the Y1–Y2 direction all being restricted. In this structure, the presence of the flange portions 223*a*, 224*a*, 233*a* and 234*a* contributes to a long distance L1 (see FIG. 14) in the X1–X2 direction in a part of the cable guide 220 fixed to the shield cover assembly 170. Therefore, the cable guide 220 is firmly fixed to the shield cover assembly 170.

Besides, when the first half guide 221 and the second half guide 231 are confronted at the Z2-end, the locking portions 233 and 223, and the locking portions 234 and 224, are coupled so that the locking portions 233 and 234 of the second half guide 231 are positioned at X2-side to the locking portions 223 and 224 of the first half guide 221, respectively, as shown in FIG. 14. Therefore, upon confronting the first half guide 221 and the second half guide 231 at the Y2-end, the locking portions 233 and 234 do not need to be positioned with respect to the locking portions 223 and 224; the first half guide 221 and the second half guide 231 have a freedom in positioning to a degree that first half guide 221 and the second half guide 231 may shift slightly in the X1–X2 direction. Specifically, first, the first half guide 221 and the second half guide 231 are confronted at the Y2-end, and thereafter, are shifted in the X1–X2 direction so as to confront the locking hook 233*b* with the locking hook 223*b*, and the locking hook 234*b* with the locking hook 224*b*. This operation can be easily performed, compared with an operation, for example, in which both the locking portions 233 and 234 are to be positioned inside the locking portions 223 and 224, and in the course of confronting the first half guide 221 and the second half guide 231 at the Z2-end, the locking portions 233 and 234 are positioned inside the locking portions 223 and 224.

Figure 16:
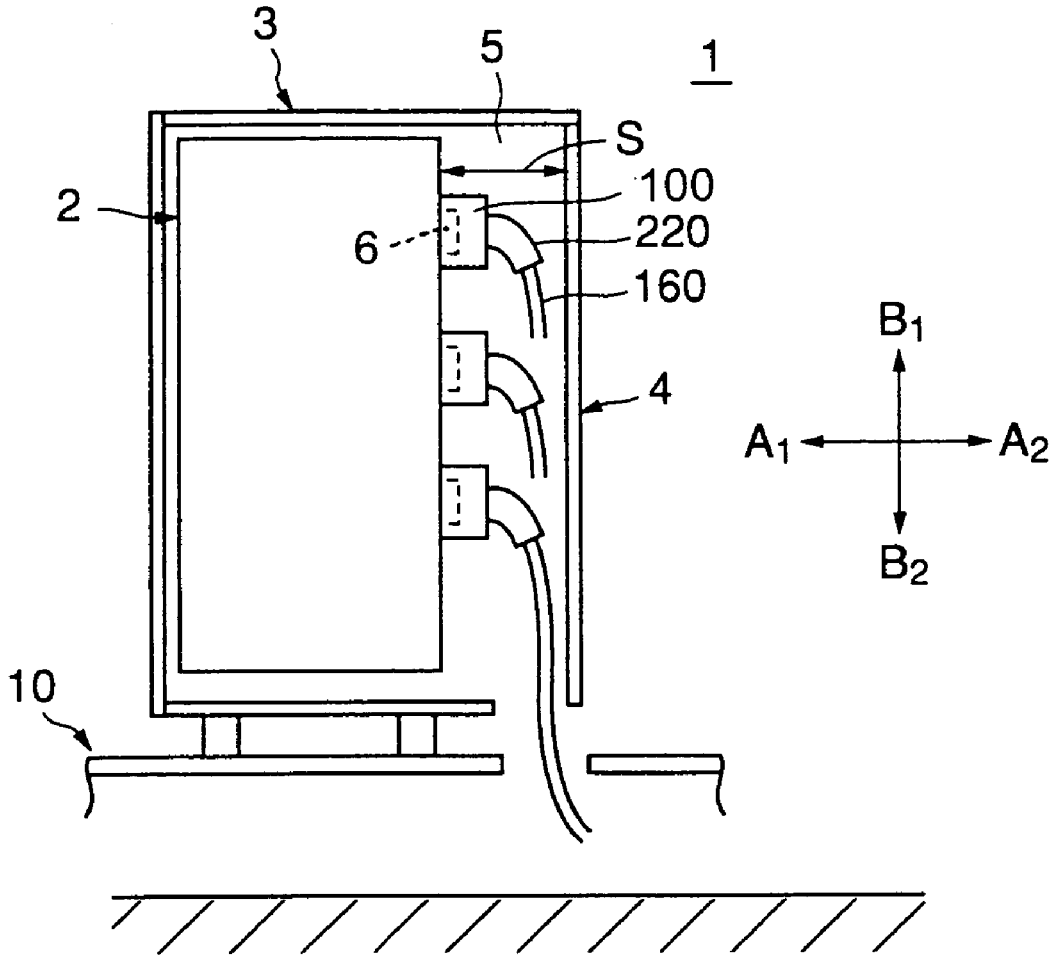
FIG. 16 shows an example in which the balanced transmission connector according to the embodiment of the present invention is used.

FIG. 16 shows an example in which the above-described connector 100 is used. The cable 160 extending from the connector 100 connected with each of the connectors 6 at the backside of the server body 2 is guided and curved forcibly, at a part leading out from the connector 100, in a B2-direction toward the free access floor 10. Thus, the cable 160 protrudes only slightly from the backside of the server body 2 in an A2-direction, compared with the conventional structure, so that the cable 160 is contained in the space 5, enabling the door 4 to be closed normally.

Figure 17:
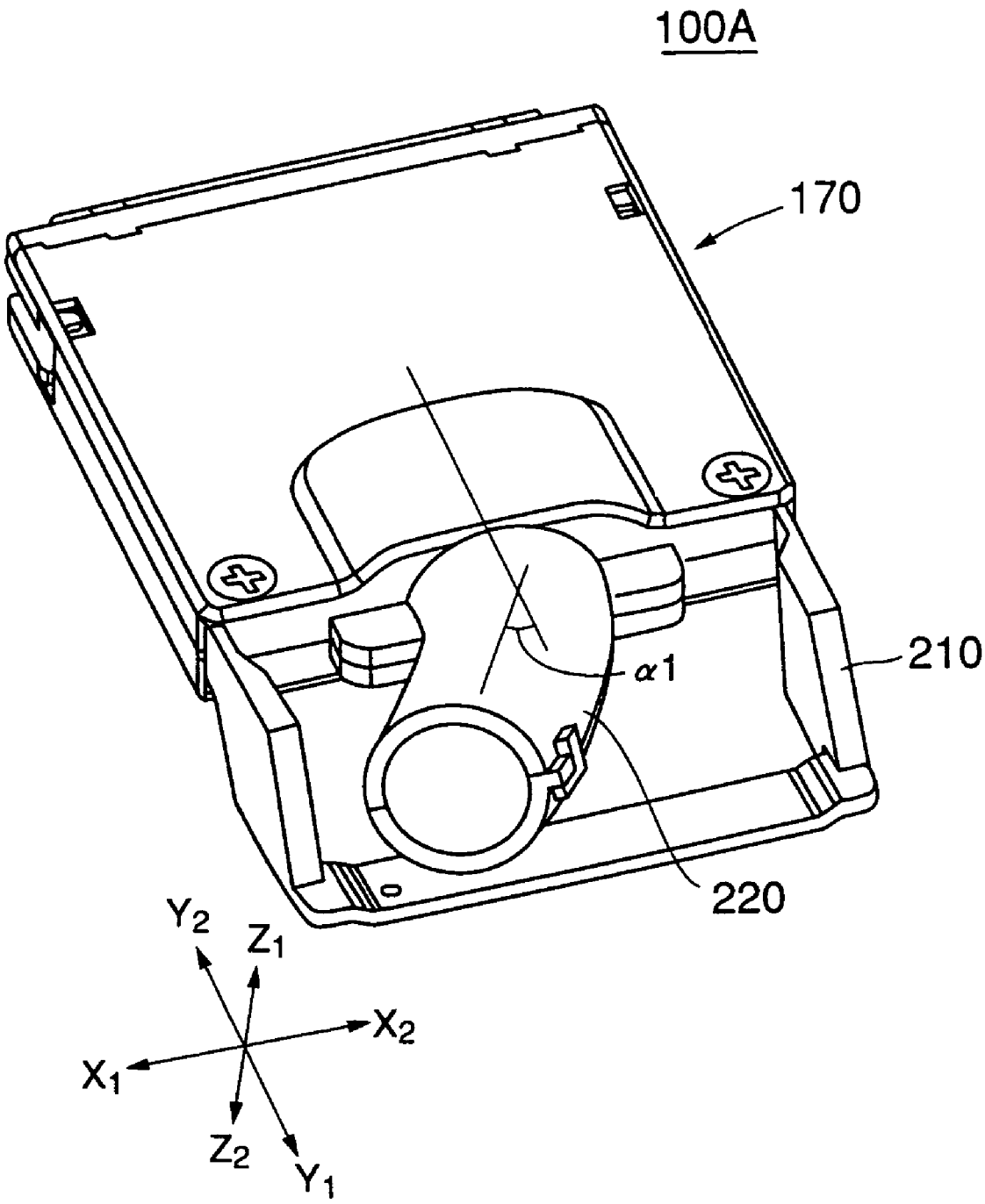
FIG. 17 is a perspective rear view of a balanced transmission connector with the cable guide attached in a different direction.

FIG. 17 shows a connector 100A having a structure in which the cable guide 220 is attached to the shield cover assembly 170 in an opposite direction with the cable guide 220 being turned 180 degrees from the direction shown in FIG. 3. Since the part of the cable guide 220 fixed to the shield cover assembly 170 is symmetrical about a center 0 (see FIG. 14, FIG. 15) of the cable-path opening 170*a*, the cable guide 220 can be attached to the shield cover assembly 170 in the opposite direction with the cable guide 220 being turned 180 degrees from the direction shown in FIG. 3.

At this point, since the connector 100 per se needs to be connected in a particular direction to a connector provided in a server, the connector 100 needs to be postured variously according to directions of the connector of the server. Therefore, the structure in which the cable guide 220 can be attached to the shield cover assembly 170 in a different direction is useful.

Besides, the cable guide 220 is a component independent from the shield cover assembly 170, and the cable guide 220 is attached detachably to the shield cover assembly 170. Accordingly, varieties of the cable guide 220 prepared to have different drawing-out angles, different radiuses of curvature, or different diameters can deal with various cables and curves having various radiuses of curvature. With these varieties of the cable guide 220, the first and second shield half covers 171 and 190 do not need varieties. Hence, costs for manufacturing metal molds (dies) can be reduced, compared with a structure in which a cable guide is united with a shield cover assembly beforehand.

Additionally, the cable guide 220 may be a single component having a curved pipe form, instead of two combined components.

Besides, the cable guide 220 may be made of a synthetic resin. The cable guide 220 includes the part fixed to the shield cover assembly 170, and the part drawing out the cable 160; in this structure, the part drawing out the cable 160 may be rotated with respect to the part fixed to the shield cover assembly 170, or the part drawing out the cable 160 may be branched into two portions.

Figure 18:
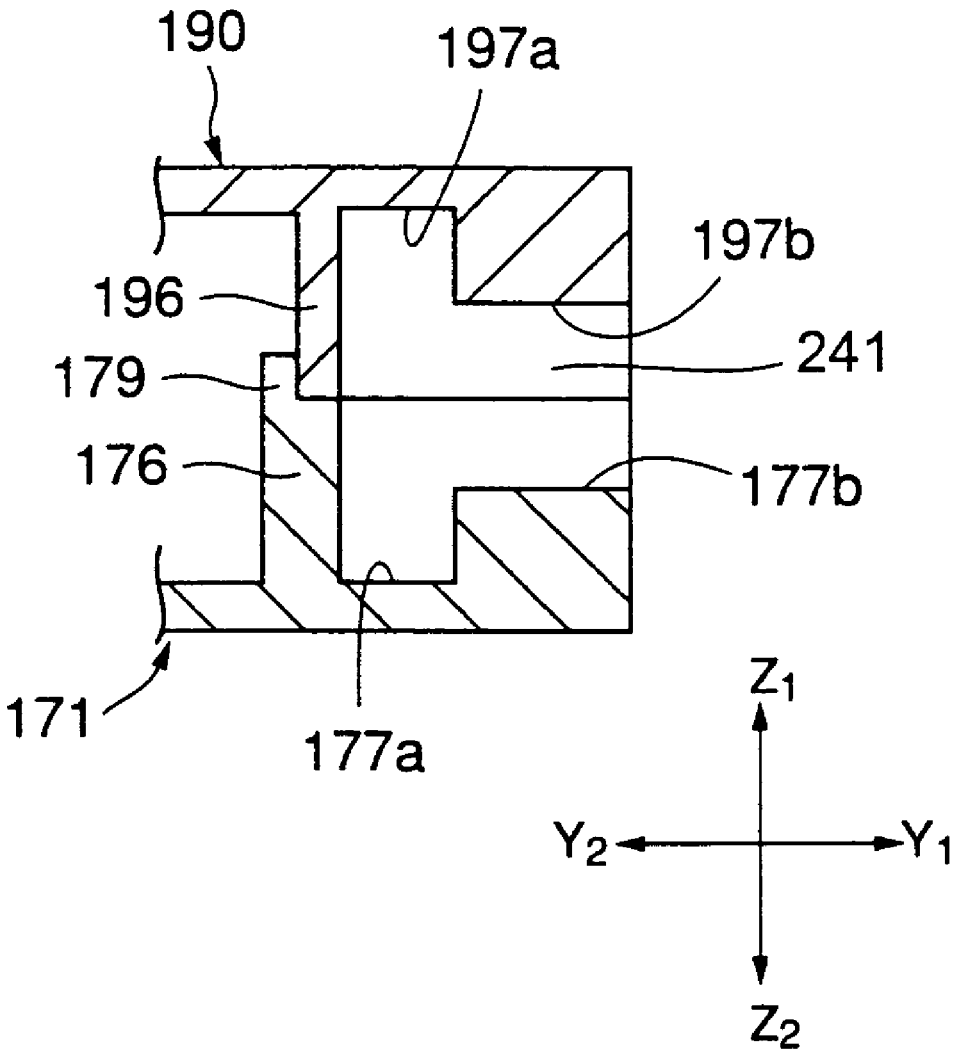
FIG. 18 is a cross-sectional view of a part of the shield cover assembly when the cable guide is not attached.

Additionally, the connector 100 is used even without the cable guide 220 being attached. FIG. 18 shows a part in the vicinity of the space 241 of the shield cover assembly 170 when the cable guide 220 is not attached. The space 241 does not reach an inside part of the shield cover assembly 170, and the auxiliary wall portion 179 shuts an edge where the wall portion 176 contacts the wall portion 196. Therefore, even when the cable guide 220 is not attached, the shield cover assembly 170 exhibits an excellent shielding property.

Additionally, the present invention is effective when the balanced transmission cable 160 is used; besides, the present invention is also effective when a common cable not for balanced transmission is used.

The present invention is not limited to the specifically disclosed embodiments, and variations and modifications may be made without departing from the scope of the present invention.

The present application is based on Japanese priority application No. 2003-043049 filed on Feb. 20, 2003, the entire contents of which are hereby incorporated by reference.

What is claimed is:

1. A shielded cabled connector with a balanced transmission cable extending from a connector cover, the cabled connector comprising;

a cable guide, independent from said connector cover, having a curved pipe shape accommodating said cable therethrough and enveloping and guiding a part of said cable leading out from said connector cover, said cable guide comprising a straight base part having a first central axis and a distal end part having a second central axis disposed at an oblique angle with respect to said first central axis of said base part, the straight base part being attached detachably to said connector cover, said connector cover comprising a first shielded half cover having a substantially U-shaped pull lever attached at a rear end on both sides of the first shielded half cover, and a second shielded half cover combinable with each other, said cable guide comprising two cable half guides combinable with each other, said first half cover and said second half cover including respective wall portions confronting each other when said first half cover and said second half cover are combined, said respective wall portions of said first and second half covers forming together a cable exit hole holding therein said cable guide when said first and second half covers are combined, and said cable guide having a pair of catching portions at a base part thereof, each of said catching portion having a flange connected with a locking hook said pair of catching portions being engaged with respective recesses formed on mutually mating surfaces of said wall portions of said first and second shielded half covers at opposite lateral sides of said cable exit hole limitedly within respective ranges of widths of said wall portions.

2. The shielded cabled connecter as claimed in claim 1, wherein:

each of the cable half guides has a semicircular cross section; and said two cable half guides are attached detachably to said connector cover.

3. The shielded cabled connector as claimed in claim 1, wherein:

said engaging parts attaching said cable guide to said connector cover are arranged symmetrically about said cable exit hole of said connector cover; and said cable guide is capable of being attached to said connector cover with an end part of said cable guide being turned in a different direction.

4. The shielded cabled connector as claimed in claim 1, wherein the cable guide is of a selected one of different, predetermined curvatures between the straight base part thereof and the distal end part thereof.

5. The shielded cabled connector as claimed in claim 4, wherein the cable guide defines a selected one of different drawing-out angles.

6. A shielded connector cover, comprising:

a first shielded half cover having a substantially U-shaped pull lever attached at a rear end on both sides of the first shielded half cover, and a second shielded half cover combinable with each other so that a cable guide is attached detachably to said shielded connector cover;

said first half cover and said second half cover comprising respective wall portions confronting each other when said first half cover and said second half cover are combined, said respective wall portions of said first shielded half cover and said second shielded half cover forming a cable exit hole when said first and second shielded half covers are combined; and a straight portion of said cable guide at a base part thereof having catching portions having respective flanges connected with corresponding locking hooks to engage respective recesses formed on mutually mating surfaces of said wall portions of said first and second shielded half covers limitedly within respective ranges of widths of said wall portions at opposite lateral sides of said cable exit hole, said cable guide having a curved shape comprising said straight base part held by said connector cover and a distal end part forming an oblique angle with respect to said base part, said first half cover and said second half cover holding said straight base part of said cable guide therebetween at a selected one of plural axial angles for said distal end part with respect to said connector cover.

7. The shielded connector cover as claimed in claim 6, wherein the cable guide is of a selected one of different, predetermined curvatures between the straight base part thereof and the distal end part thereof.

8. The shielded connector cover as claimed in claim 7, wherein the cable guide defines a selected one of different drawing-out angles.

* * * * *

UNITED STATES PATENT AND TRADEMARK OFFICE

CERTIFICATE OF CORRECTION

PATENT NO. : 7,004,783 B2
APPLICATION NO. : 10/626667
DATED : February 28, 2006
INVENTOR(S) : Tadashi Kumamoto et al.

It is certified that error appears in the above-identified patent and that said Letters Patent is hereby corrected as shown below:

Column 10,
Line 21, after "hook" insert -- , --.

Signed and Sealed this

Twenty-seventh Day of June, 2006

JON W. DUDAS
*Director of the United States Patent and Trademark Office*